US008528535B2

(12) United States Patent
Morris, II

(10) Patent No.: US 8,528,535 B2
(45) Date of Patent: Sep. 10, 2013

(54) ARCHERY APPARATUS, SYSTEM, AND METHOD

(76) Inventor: Edward J. Morris, II, Mardela Springs, MD (US)

( * ) Notice: Subject to any disclaimer, the term of this patent is extended or adjusted under 35 U.S.C. 154(b) by 398 days.

(21) Appl. No.: 12/874,941

(22) Filed: Sep. 2, 2010

(65) Prior Publication Data

US 2011/0277738 A1 Nov. 17, 2011

Related U.S. Application Data

(63) Continuation-in-part of application No. 12/780,394, filed on May 14, 2010.

(51) Int. Cl.
*F41B 5/00* (2006.01)

(52) U.S. Cl.
USPC ..... 124/86; 124/25.6

(58) Field of Classification Search
USPC ..... 124/23.1, 25.6, 86, 88
See application file for complete search history.

(56) References Cited

U.S. PATENT DOCUMENTS

| | | | | |
|---|---|---|---|---|
| 3,739,167 | A | 6/1973 | Avery | |
| 4,134,383 | A * | 1/1979 | Flood | 124/25.6 |
| 4,741,320 | A * | 5/1988 | Wiard | 124/23.1 |
| 5,060,626 | A | 10/1991 | Elliott et al. | |
| 5,205,268 | A * | 4/1993 | Savage | 124/24.1 |
| 5,297,533 | A | 3/1994 | Cook | |
| 7,337,773 | B2 * | 3/2008 | Simo et al. | 124/44.5 |
| 2008/0000465 | A1 | 1/2008 | Holmberg | |
| 2010/0043765 | A1 * | 2/2010 | Lang | 124/25.6 |

OTHER PUBLICATIONS

U.S. Appl No. 12/780,394—Non-Final Office Action dated Jun. 5, 2012.

U.S. Appl. No. 12/780,394—Notice of Allowance dated Nov. 5, 2012.

U.S. Appl. No. 12/780,394—Allowed Claims (Clean Version).

* cited by examiner

*Primary Examiner* — John Ricci

(74) *Attorney, Agent, or Firm* — Miles & Stockbridge P.C.

(57) ABSTRACT

Systems, apparatuses, and methods for controlling and/or selecting one or more accessory devices for an archery apparatus, including circuitry for remotely controlling and/or selecting for activation one or more electrical or electronic accessory devices. The electrical or electronic accessory devices can include a stabilizing light, a spot light, a video recorder, a photographic camera, an audio enhancement pickup, a fishing reel, a range finder, sights, a lighted quiver, and a game call.

18 Claims, 6 Drawing Sheets

ARCHERY APPARATUS, SYSTEM, AND METHOD

CROSS-REFERENCE TO RELATED APPLICATION

This application is a continuation-in-part of application Ser. No. 12/780,394 filed May 14, 2010.

FIELD OF THE INVENTION

The present invention relates to systems, apparatuses, and methods for wirelessly controlling and/or selecting for activation one or more accessory devices for an archery apparatus. In particular, the present invention relates to circuitry for wirelessly controlling and/or selecting for activation one or more electrical accessory devices for a compound archery bow.

SUMMARY

Various disclosed embodiments (i.e., one, some, or all) of the present invention relate to a compound archery bow comprising: a bow string; and an elongate body operatively coupled to the bow string. The body can include an integrated selector, a grip portion having an integrated momentary switch, an integrated stabilizer mounting port, and a plurality of accessory attachment ports. Optionally, the momentary switch can include a wireless transmitter and the selector can include a wireless transceiver, wherein the momentary switch and the selector can be configured to communicate wirelessly with each other via the transmitter and transceiver. Optionally, the selector can be configured to selectively control wireless communication from the momentary switch for one or more electronic accessory devices mechanically coupled to respective accessory attachment ports, and the momentary switch can be configured to be activated so as to activate one or more of the electronic accessory devices mechanically coupled to respective accessory attachment ports based on the selective control of the selector. One or more electronic accessory devices can each include a receiver to receive wireless communication from the compound archery bow. Optionally, the one or more electronic accessory devices can receive wireless communication from the selector based on communication from the transmitter of the momentary switch. The selector can include visual indicators to indicate selective control of the one or more electronic accessory devices. The momentary switch can be configured to be activated by a user of the bow. The electronic accessory devices can include at least one of a light, a stabilizing light, a spot light, a video device, a photographic device, an audio enhancement device, a reel device, a game calling device, a range finder device, a sighting device, and a lighted quiver device. Optionally, when one of the electronic accessory devices includes a stabilizing light, the stabilizer mounting port can be mechanically coupled to the stabilizing light, and the stabilizing light can be wirelessly controlled by the selector and the momentary switch. Optionally, upon activation, power to the one or more electronic accessory devices mechanically coupled to respective accessory attachment ports based on the selective control of the selector can be provided from respective power sources of the one or more electronic accessory devices. Optionally, the one or more electronic accessory devices can receive wireless communication from the transmitter of the momentary switch based a selection configuration of the selector. The selector can be configured to allow none, only one, only some, or all electronic accessory devices to be operated at one time, with each said electronic accessory device having its own control frequency associated therewith.

Various embodiments also include an archery apparatus comprising: a bow string; and a body operatively coupled to the bow string, wherein the body can include a grip portion, a wireless control device, and one or more accessory ports. Each of the accessory ports can provide a mechanical coupling to the body for respective electrical accessory devices. The wireless control device can be configured to wirelessly control electrical accessory devices coupled to the body, wherein the wireless controlling includes controlling a supply of power. The wireless control device also can be configured to be activated by a user of the archery apparatus, wherein the activation of the wireless control device can provide power to certain electrical accessory devices coupled to the body. Optionally, the supply of power can include power supplies for each of the electrical accessory devices, wherein the power supplies can be respectively provided by the electrical accessory devices, and the wireless control can be provided by one of RF signals or IR signals. The electrical accessory devices can include at least one of a light, a stabilizing light, a spot light, a video device, a photographic device, an audio enhancement device, a reel device, a game calling device, a range finder device, a sighting device, and a lighted quiver device.

Various embodiments also can include a system for controlling activation of one or more accessory devices electrically coupled to an archery apparatus. The system can comprise means for wirelessly controlling power supplied to the one or more accessory devices for activation thereof; and means for coupling to a first external body portion of the archery apparatus the means for wirelessly controlling power. Optionally, the system can further comprise means for wirelessly selecting the one or more accessory devices for activation thereof; and means for coupling to a second external body portion of the archery apparatus the means for wirelessly selecting the one or more accessory devices for activation. The means for wirelessly controlling power can include wireless connection means for wirelessly communicating with the means for wirelessly selecting the one or more accessory devices for activation, wherein the wireless connection means can be exposed from the body of the archery apparatus. Optionally, the means for wirelessly selecting the one or more accessory devices for activation can use a plurality of wireless communication channels, each of the one or more accessory device having associated therewith one of the plurality of wireless communication channels. Optionally, the means for wirelessly controlling power can include means for selecting said one or more accessory devices for activation thereof. The means for wirelessly selecting the one or more accessory devices for activation can be configured to selectively allow none, only one, only some, or all electrical accessory devices to be operated substantially simultaneously.

Various embodiments can also include a method comprising: coupling a plurality of devices each having an electrical component to respective receptacles of a compound bow; operating one or both of a momentary switch and a selector to selectively and wirelessly control the electrical components of the devices; and prior to operating one or both of a momentary switch and a selector to wirelessly control the electrical component of the device, performing a device discovery operation to identify the devices coupled to the receptacles of the compound bow, the device discovery operation being performed by an electronic controller. Optionally, the device discovery operation can be performed automatically, continuously, and/or periodically by the electronic controller.

BRIEF DESCRIPTION OF THE DRAWINGS

The accompanying drawings illustrate embodiments of the disclosed subject matter. The disclosed subject matter will be best understood by reading the ensuing specification in conjunction with the drawing figures, in which like elements are designated by like reference numerals, and wherein.

DETAILED DESCRIPTION

Generally speaking, various embodiments of the present invention involve an archery apparatus, such as an archery bow used for hunting game, for example, wherein the archery apparatus can provide for user control and/or activation (wirelessly or otherwise) of one or more electrical or electronic accessory devices coupled to the apparatus, either substantially permanently or removably. The archery apparatus can be "configured" and/or "reconfigured" by coupling thereto any suitable electrical or electronic accessory device. Various embodiments can comprise, for example, an electronic control device for use by a user of the archery apparatus to activate (wirelessly or otherwise) any electrical or electronic device mounted on the archery apparatus with a touch of a button, while at full draw, for instance. Generally speaking, for an electronic control device of wireless type, which can be either substantially permanently or temporarily affixed to the bow 100, the electronic device can wirelessly communicate with respective wireless receivers associated with one or more electrical or electronic accessory devices to control and/or activate the accessory devices. Optionally, some or all of the wireless receivers can be built in to each of the accessory devices. Alternatively, some or all of the wireless receivers can be part of the bow itself. The wireless communication can be of any suitable format, such as by infrared ("IR") signals or by radio frequency ("RF") signals. In such embodiments, the wireless communication interface can be provided in conformance with one or more open or closed wireless technology standards or protocols for exchanging data over short distances, such as, for example, but not limited to, Bluetooth® and/or IEEE 802.15.1 or a wireless local area network ("WLAN") in conformance with IEEE 802.11. Furthermore, in various embodiments, each electronic or electrical accessory device can be operated wirelessly via its own control frequency. For example, each electronic or electrical accessory device can be operated wirelessly using its own unique communication channel or code, for example, based on a setting or selection of a selector. Optionally, the electronic control device of wireless type can perform a device discovery operation to identify electrical or electronic accessory devices coupled to receptacles or in proximity to the compound bow. In various embodiments the device discovery operation is performed automatically. Optionally, the device discovery operation is performed automatically, continuously, and/or periodically.

Figure 1:
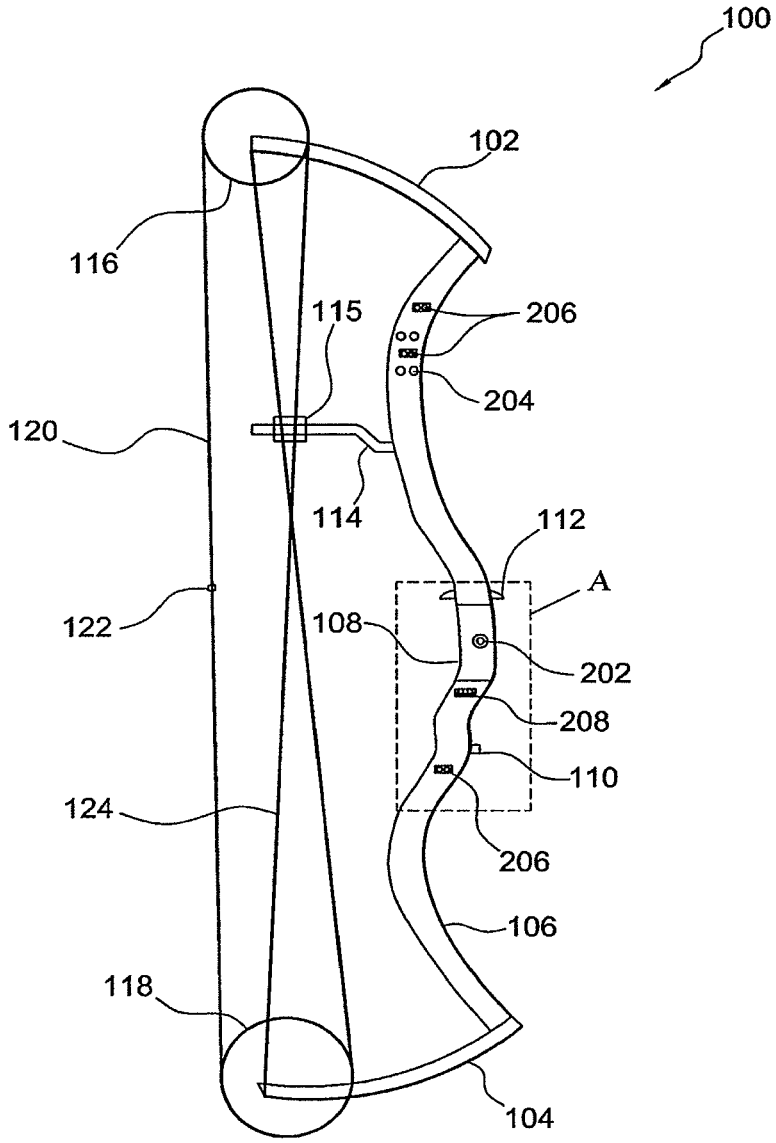
FIG. 1 is a side view drawing of a compound archery bow according to various embodiments of the disclosed subject matter.
Figure 2:
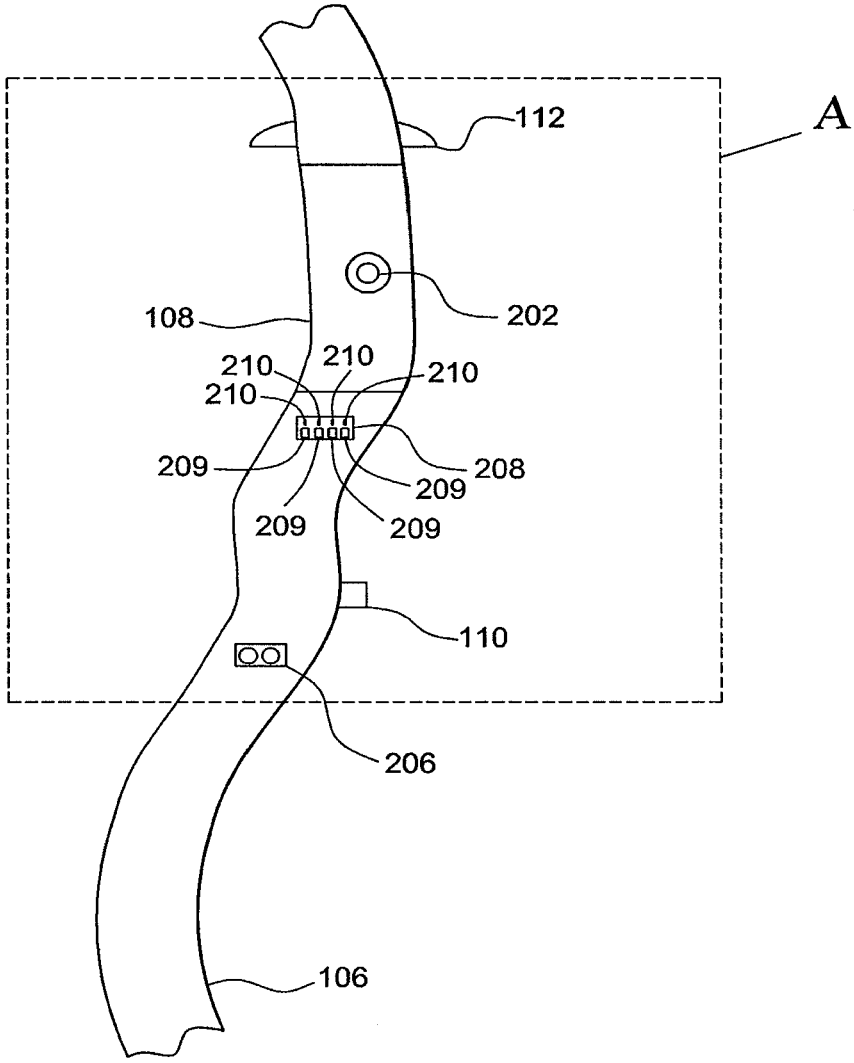
FIG. 2 is a close-up view of a portion 'A' from FIG. 1.

For example, FIG. 1 is a side view of a compound bow 100 according to various embodiments of the disclosed subject matter. FIG. 2 is a close up view of a portion 'A' from FIG. 1. As noted above, generally, the compound bow 100 of FIGS. 1 and 2 can provide for user control and/or activation (wirelessly or otherwise) of one or more electrical or electronic accessory devices coupled to the bow 100, either substantially permanently or removably.

Compound bow 100 can comprise a body having an upper limb 102, a lower limb 104, a riser 106, a grip 108, a stabilizer mounting port 110, and an arrow rest 112. The physical arrangement and shapes of the aforementioned features can be such as shown in FIGS. 1 and 2, for example, wherein a portion of the bow containing the grip 108, stabilizer mounting port 110, and arrow rest 112 is coupled between upper limb 102 and lower limb 104. The body of the compound bow 100 also may have a cable guard 114 having a cable slide 115 coupled thereto, as well as an idler wheel 116 coupled to upper limb 102, a cam 118 coupled to lower limb 104, a cable 124 coupled to idler wheel 116 and cam 118, and a bow string 120 having a knock location 122 and being coupled to idler wheel 116 and cam 118.

Optionally, stabilizer mounting port 110 can be an electrically conductive mounting port connected to circuitry integrated into the body of the compound bow 100 and for connection to electrical or electronic accessory devices, such as a stabilizing light. Such an electrically conductive mounting support can provide both mechanical and electrical coupling for one or more electrical or electronic accessory devices configured to be coupled mechanically and electrically thereto. Alternatively, stabilizer mounting port 110 can provide physical mounting for an electrical or electronic accessory device, such as a stabilizing light, wherein the accessory device can be wirelessly controlled by an electronic control device.

Optionally, various embodiments of compound bow 100 also can have a momentary switch 202, one or more accessory mounts or ports 204, and one or more electrical ports 206. Optionally or alternatively, compound bow 100 can have a selector 208. Optionally, compound bow 100 can have one or more power supplies (not explicitly shown) integrated in the body of the compound bow 100.

In various embodiments, the electronic control device can include momentary switch 202 and/or selector 208. Furthermore, optionally, the electronic control device can be a wireless control device that can wirelessly control and/or activate one or more electrical or electronic accessory devices coupled to or otherwise in relative proximity to the electronic control device. In various embodiments, the electronic control device can include a wireless transmitter for communicating (i.e., transmitting) wireless signals to receivers associated with the aforementioned electrical or electronic accessory devices coupled to or otherwise in relative proximity to the electronic control device. In various embodiments, the electronic control device (of the wireless type or otherwise) can control power supplied to the aforementioned electrical or electronic accessory devices. Optionally, power supplied to the electrical or electronic accessory devices can be provided by power supplies located on the electrical or electronic accessory devices themselves. In the case of an electronic control device of the wireless type comprised of momentary switch 202 and selector 208, the momentary switch can include a wireless transmitter (e.g., an RF or IR transmitter) and the selector can include a wireless transceiver (e.g., an RF or IR transceiver). In such embodiments, the momentary switch and the selector can communicate wirelessly with each other via the wireless transmitter and transceiver to control and/or activate one or more electrical or electronic accessory devices based on a user input; the momentary switch and/or the selector can communicate wirelessly with wireless receivers (e.g., an RF or IR receiver) of the one or more electrical or electronic accessory devices. For example, in various embodiments, the selector can be set or otherwise used to selectively control wireless communication from the momentary switch for one or more electronic or electrical accessory devices. Thus, in this example, one or more of the electronic or electrical accessory devices can be selectively activated (e.g., power turned on) based on the configuration of the selector. Optionally, wireless communication can be provided by the momentary switch directly to the one or more electronic devices based on the configuration of the selector. Optionally or alternatively, the one or more electronic accessory devices can receive wireless communication from the selector based on wireless communication from the transmitter of the momentary switch.

Momentary switch 202 can be of any suitable configuration, including configurations capable of being depressed or otherwise "switched" by a user of the compound bow 100 (e.g., a continuity switch). Momentary switch 202 can be integrated or formed essentially in one piece with the body of the compound bow 100, for example, during the manufacturing process. Alternatively, momentary switch 202 can be affixed, substantially permanently or removably, to the body of the compound bow 100 after the manufacturing process. Furthermore, momentary switch 202 can be provided at any suitable location on the body of the compound bow 100. Generally speaking, momentary switch 202 can be arranged on the body of the compound bow 100 at a position where a user may access the momentary switch 202 at particular instances, such as when the user is "shooting" or "aiming" the compound bow 100, using the compound bow 100 for guidance or tracking purposes (e.g., activating a flashlight coupled to the bow and switch), etc. Incidentally, momentary switch 202 can be arranged on either side of the body of the compound bow 100, depending on the "handedness" (i.e., left or right "handed") of the compound bow 100. FIGS. 1 and 2, for example, show momentary switch 202 being arranged on one side of grip 108. Alternatively, momentary switch 202 can be arranged either above or below grip 108.

In various embodiments, momentary switch 202 can be used to control or activate one or more accessory devices coupled to the compound bow 100 (devices not shown in FIGS. 1 and 2). As will be discussed in more detail later, each accessory device can be either substantially permanently fixed or removably coupled to the body of the compound bow 100. Furthermore, optionally, momentary switch 202 can include a wireless communication capability, and the momentary switch 202 includes a wireless transmitter for wirelessly controlling and/or activating one or more electrical or electronic accessory device.

Momentary switch 202 can be operative in any suitable way for making and breaking electrical contact. For example, momentary switch 202 can operate such that when activated, by a user of the compound bow 100, for example, the momentary switch 202 makes contact for a set time period and then automatically releases, after a delay (which can be set and/or adjusted by the manufacturer or the user), to open the circuit, regardless of whether the switch is "held down" or released. Such feature can be advantageous in that the user may not have to concentrate on holding down the button, for example, while aiming or shooting. Alternatively, momentary switch 202 can remain closed as long as the user holds or pushes down a button or otherwise activates a mechanism associated with activation of the momentary switch 202.

In various embodiments, momentary switch 202 can be electrically coupled to the stabilizer mounting port 110 (if the stabilizer mounting port 110 is of the conductive type), to one or more of the accessory mounts 204 (if of the conductive type), and/or to the one or more electrical ports 206. In various embodiments, the electrical connections or connectors (e.g., circuitry, such as wires, contacts, switches, etc.) between the momentary switch 202 and the stabilizer mounting port 110, the one or more accessory mounts 204, and the one or more electrical ports 206 can be integrated into or within the body of the compound bow 100. That is to the say, in various embodiments, substantially none of the electrical connections or connectors can be seen in plain view. Accordingly, various embodiments of the present invention provide internal connectivity.

Momentary switch 202 can be used to control or activate one or more electrical or electronic accessory devices electrically coupled thereto. For example, activation and deactivation of the momentary switch 202 can control a signal, power, voltage, or current supplied to a light electrical accessory device, such as a stabilizing light electrically accessory device, electrically and mechanically coupled to stabilizer mounting port 110. Incidentally, a stabilizing light electrical accessory device can be mechanically and/or electrically coupled to the momentary switch 202 by a threaded female receptacle or boss in the body of the compound bow 100, for example, the same as or similar to receptacles used for coupling of a stabilizer bar to the compound bow 100. In various embodiments that are comprised of momentary switch 202 without selector 208, activation of the momentary switch 202 may control and/or activate all or some of the electrical or electronic accessory devices electrically coupled to the body of the compound bow 100. Control and/or activation can include supplying a power source, such as power, voltage, or current to one or more accessory devices. Optionally, control and/or activation can include providing a signal, control or otherwise, to one or more of the accessory devices.

As mentioned above, optionally or alternatively, compound bow 100 can have a selector 208. Though the term "selector" has been used to describe element 208, its function is not limited to "selecting." For example, selector 208 may be manipulated to control one or more of the electrical or electronic accessory devices electrically coupled to it. As but one example, after activation of a video camera (using the momentary switch 202 and/or the selector 208), selector 208 may be manipulated, by the user, to stop recording, pause recording, zoom in, zoom out, etc. Other electrical or electronic accessory devices can be controlled in a similar fashion, based on their respective characteristics.

Selector 208 can be integrated with the body of the compound bow 100, for example, during the manufacturing process. Optionally, selector 208 can be electrically coupled between momentary switch 202 and each electrical port 206 and each accessory mount 204 that is also an electrical conductor. Selector 208 can allow none, only one, only some, or all electrical or electronic accessory devices electrically coupled to the body of the compound bow 100 to be operated or controlled at one time or substantially simultaneously. Thus, momentary switch 202 can be electrically coupled directly to each electrical or electronic accessory device or can be routed through selector 208 for selectively controlling the electrical or electronic accessory devices electrically coupled to the body of the compound bow 100.

Selector 208 can be of any suitable configuration, such as one or more pushbuttons, levers, etc. Selector 208 in the dashed box 'A' in FIG. 2, for example, shows four buttons 209. Selector 208 also may be configured with indicators 210, such as LEDs or other lights or indicia to indicate a state of the selector with respect to the electrical accessory devices, such as presently selected electrical accessory devices FIG. 2, for example, shows four indicators 210 corresponding to the four buttons 209. Selector 208 can provide a signal, such as a control signal, and/or power to one or more of the selected electrical or electronic accessory devices.

In an alternative embodiment, selector 208 can replace completely momentary switch 202. Thus, electronic or electrical accessory devices coupled to the body of the compound bow 100 can be controlled and/or activated based on only selector 208. Selector 208 can provide a signal, such as a control signal, and/or power to one or more of the selected electrical or electronic accessory devices.

The one or more accessory mounts 204 can be of any suitable configuration, such as a male, female, or combination male/female mount for mechanically and/or electrically coupling various electrical or electronic accessory devices to the body of the compound bow 100. Each individual accessory mount 204 can be integrated or formed essentially in one piece with the body of the compound bow 100, for example, during the manufacturing process.

The one or more electrical ports 206 can be of any suitable configuration, such as a male, female, or combination male/female receptacle for electrically coupling various electrical or electronic accessory devices to the body of the compound bow 100. Each electrical port 206 can be integrated or formed essentially in one piece with the body of the compound bow 100, for example, during the manufacturing process.

In various embodiments, one of said electrical ports 206 may be associated with a corresponding accessory mount 204. For example, a non-conductive accessory mount 204 may be for physically or mechanically coupling a particular electrical or electronic accessory device to the body of the compound bow 100 and an electrical connection for the electrical or electronic accessory device may be provided by the corresponding electrical port 206. In such embodiments, the electrical coupling means (e.g., a wire) from the accessory device to the electrical port 206 may be visible in plain view, with an end of the coupling means being plugged into, for example, the electrical port 206.

In various embodiments, the compound bow 100 can have one or more power supplies for supplying power to various electrical or electronic accessory devices. Each of the power supplies can be integral with the body of the compound bow 100 (e.g., arranged in a hollow portion of the body), or can be electrically and mechanically coupled to the body of the compound bow 100, for example, by using one or more mounts 204 and corresponding one or more of the electrical ports 206. Thus, various embodiments of the present invention can have power supplied to momentary switch 202 and/or selector 208, and consequentially to the mounts 204 of the electrically conductive type and electrical ports 206, and to the corresponding electrical or electronic accessory devices based on an external or internal power supply. Optionally, the power supply can come from one or more of the electrical or electronic accessory devices electrically coupled to the body of the compound bow 100. Optionally, the momentary switch 202 and/or selector 208 may provide a ground path for a power supply provided on the electrical or electronic accessory devices electrically coupled to the body of the compound bow 100. Optionally or alternatively, the compound bow 100 may have one or more solar panels to charge a battery integral with or affixed to the body of the compound bow 100, the battery in this case being the power supply or an alternative (e.g., backup) power supply for the various electrical or electronic accessory devices.

Applicants' invention is not limited to the specific compound bow 100 configuration shown in FIG. 1, and any suitable compound bow configuration may be used. Furthermore, though Applicants' disclosure and FIGS. 1 and 2 have thus far described compound bows, the features described herein may be applicable to any suitable "bow" apparatus, including compound cross-bows and non-compound bows, such as a composite bow, a long bow, a crossbow, etc.

Electronic or electrical accessory devices for coupling to an archery apparatus according to various embodiments, such as compound bow 100, can include any suitable devices, such as for safety or for providing information to a user in real time. Such electronic or electrical devices can include a stabilizing light, a spot light (where legal), a video recorder (e.g., a camcorder operated on a closed or open circuit), a photographic camera (including combined video/photographic devices), an audio enhancement pickup device, a fishing reel (e.g., for bow fishing), a game call, a range finder, a sight, an electric motor-driven device, a lighted quiver device, etc. Optionally, a range finder device implemented with the archery apparatus according to various embodiments can provide for one touch integrated range finding at full draw with LED display. Furthermore, sights that use lights, for example, can be implemented with the archery apparatus according to various embodiments such that the lights of the sight are activated only when needed, with a touch of the momentary switch 202 and/or selector 208. Such features can save battery life and eliminate extra movement in a tree stand, for example. Optionally, a range finder and a sight device may be a fully integrated system, whereby the range finder can compute distances to various objects and relay the information to an electronic sight that delivers accurate sight pin placement. In various embodiments, momentary switch 202 and/or selector 208 can assist with relaying information to the electronic sight.

Figure 3:
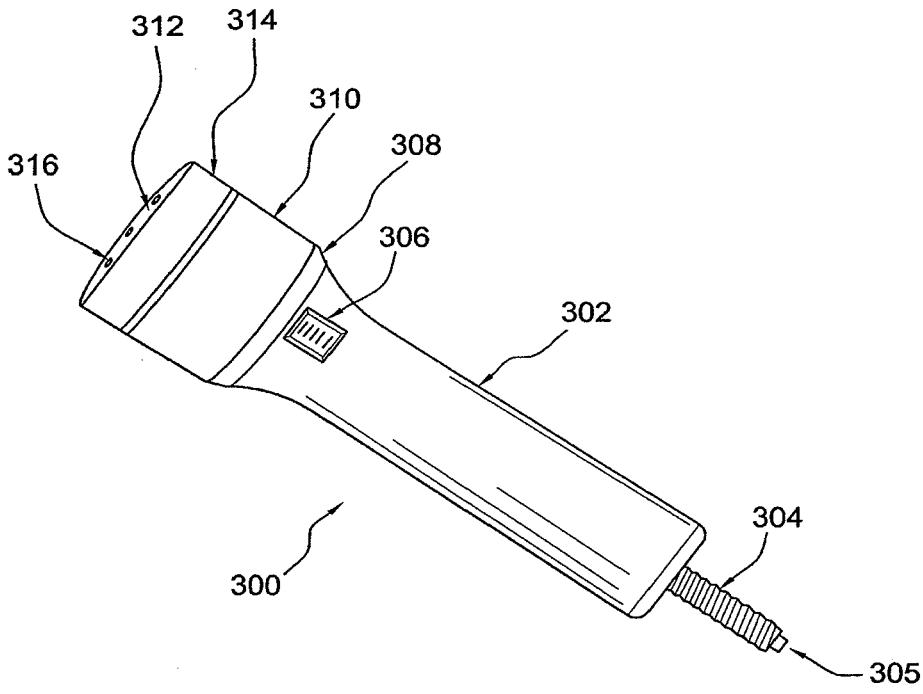
FIG. 3 shows a perspective view of an electrical or electronic accessory device in the form of a stabilizing light according to various embodiments of the disclosed subject matter.

FIG. 3 shows a perspective view of an electrical or electric accessory device in the form of a stabilizing light 300 according to various embodiments of the disclosed subject matter. Stabilizing light 300 can be of any suitable configuration. Optionally, stabilizing light 300 can provide a light source. Optionally, the stabilizing light 300 can provide a means by which to stabilize the compound bow 100. Optionally, stabilizing light 300 can provide both, a light source and a means by which to stabilize the compound bow 100. The stabilizing light 300 shown in FIG. 3 can include, for example, a body 302, which can provide a battery storage facility and/or internal components for light operation; a threaded male connection 304, which can provide ground and may be hollow and provide insulation for a "hot" lead 305. Threaded male connection 304 can be configured to be threadedly coupled to stabilizer mounting port 110, thereby being placed in electrical connection with momentary switch 202. Stabilizing light 300 also can include an on/off switch 306, a pivoting connection 308 and pivoting head 310 for directional adjustment, a lens 312, a lens retainer 314, and a light emitting means 316, such as a light bulb, one or more LED, etc. The light emitting means 316 can output any suitable light, such as blue light, green light, red light, light for blood tracking, ultraviolet light, red night light, etc.

Typically, the stabilizing light 300 would attach to the stabilizing mounting port 110 of the compound bow 100. As mentioned earlier, in various embodiments, all or substantially all conductivity points can be integrated within the bow body, which can mean no or substantially no external wiring or cords.

When installed, the stabilizing light 300 can be operated by pressing the momentary switch 202, for example. In various embodiments, the stabilizing light 300 can be functional to provide a light source when it is coupled to the stabilizer mounting port 110, or, in alternative embodiments, when not coupled thereto, since, in various embodiments the stabilizing light 300 can have its own power source (e.g., batteries). In the case where it is used while decoupled from the compound bow 100, on/off switch 306 can be used for controlling output of light. Stabilizing light 300 can be removed and replaced with a conventional stabilizer without alterations to the compound bow 100.

Figure 4:
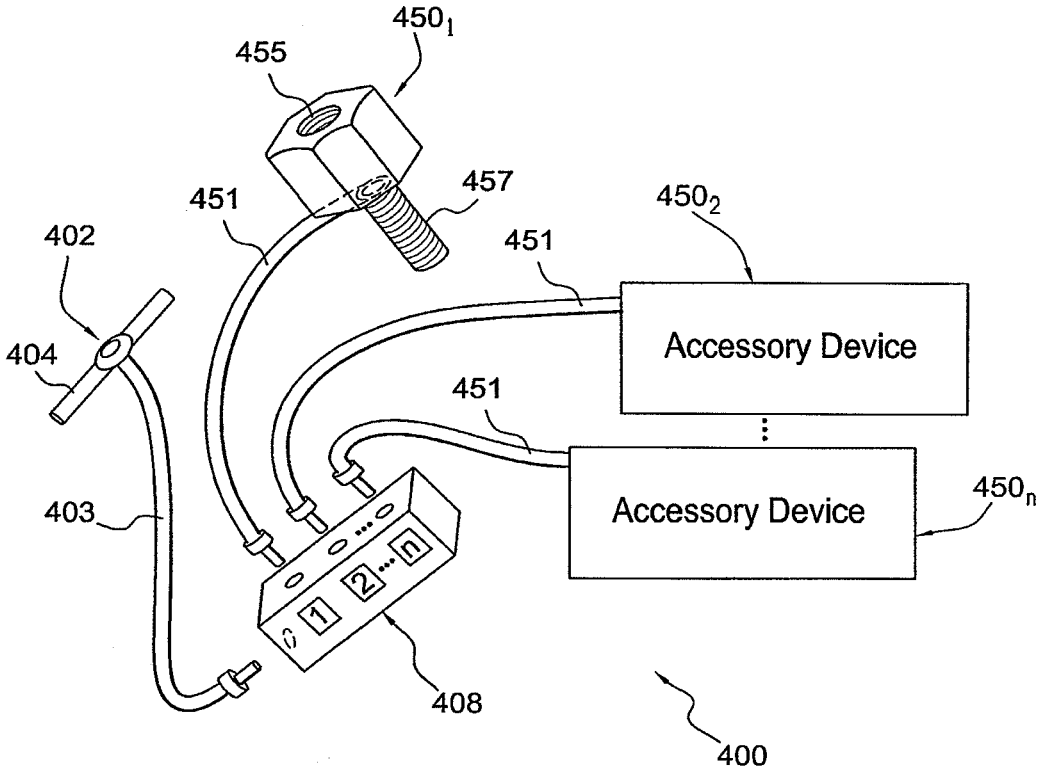
FIG. 4 is representation of a non-integral system for controlling various electronic or electrical accessory devices coupled to an archery apparatus according to various embodiments of the disclosed subject matter.

FIG. 4 is a representation of a non-integral system 400 for controlling various electronic or electrical accessory devices coupled to an archery apparatus according to various embodiments of the disclosed subject matter.

Generally speaking, the non-integral system 400 can function in the same manner as the integral system described above with respect to FIGS. 1 and 2. However, the system 400 is termed non-integral in the sense that some components can be "add-ons," coupled externally to any suitable compound bow (or any type of bow for that matter) after manufacture thereof. In particular, the system 400 is non-integral in the sense that selector 408 is not formed in one piece with the body of the compound bow 100, but rather, can be coupled to the body of the compound bow 100 after manufacture, for example, by the manufacturer itself, a retailer, or a retail customer. Optionally, momentary switch 402 also is not formed in one piece with the body of the compound bow 100 and can be coupled to the body of the compound bow after manufacture. Optionally, embodiments can include either one or the other of the selector 408 and momentary switch 402, or both the selector 408 and momentary switch 402. For example, momentary switch 402 can (1) plug directly into any electronic or electrical accessory device coupled to the body of the compound bow 100, or (2) can be routed through selector 408, which can allow one or multiple electronic or electrical accessory devices to be controlled or operated at one time or substantially simultaneously.

System 400 also is non-integral in the sense that an electrical connection or connections 403 (e.g., a connector wire, wires, or cabling) from momentary switch 402 to the selector 408 (if implemented) or directly to an electrical or electronic accessory device coupled to the body of the compound bow is exposed. Similarly, respective electrical connections 451 from selector 408 to one or more of the electronic accessory devices $\mathbf{450}_{1\text{-}n}$ coupled to the body of the compound bow are exposed.

Momentary switch 402 can be removably coupled at any suitable position on the body of the bow, by any suitable means, such as at grip 108 via hook-and-loop fasteners 404, for example. In terms of electrical functionality, momentary switch 402 can function substantially the same as momentary switch 202 described above. Momentary switch 402, however, can be configured for direct electrical connection to an electrical or electronic accessory device (for example, devices $\mathbf{450}_{1\text{-}n}$ in FIG. 4). The direct connection can be via exposed wiring or cabling 403. Alternatively, momentary switch 402 can be routed through selector 408. Likewise, the electrical connection between these devices can be via exposed wiring or cabling 403.

Selector 408 can be removably coupled at any suitable position on the body of the bow, by any suitable means, such as below or above grip 108 via hook-and-loop fasteners, for example (not shown). In terms of electrical functionality, selector 408 functions substantially the same as selector 208 described above. Selector 408, however, can be configured for direct electrical connection from one or more electrical or electronic accessory devices (devices $\mathbf{450}_{1\text{-}n}$ in FIG. 4). The direct electrical connection can be provided via exposed wiring or cabling 451. In such case, some or all of mounting ports 204 and electrical ports 206 from FIGS. 1 and 2 may not be present. Selector 408 can be outfitted with any suitable number of ports (e.g., 1 through n, where 'n' is an integer) for connection to the momentary switch 402 and any suitable number of electronic or electrical accessory devices $\mathbf{450}_{1\text{-}n}$. These connections can be by way of quick-connect plugs, for example.

As an example of an electronic or electrical accessory device 450 for use in system 400, can be a female stabilizing coupling or boss $\mathbf{450}_1$ that is tapped 455 for receiving a stabilizer light (or a stabilizer) and configured with a threaded rod 457 such that it can be threaded into a stabilizer mounting port, such as that described above with respect to FIGS. 1 and 2. The female stabilizing coupling $\mathbf{450}_1$ also can be coupled directly to selector 408 via connection 451, or alternatively momentary switch 402 (not explicitly shown).

Figure 5:
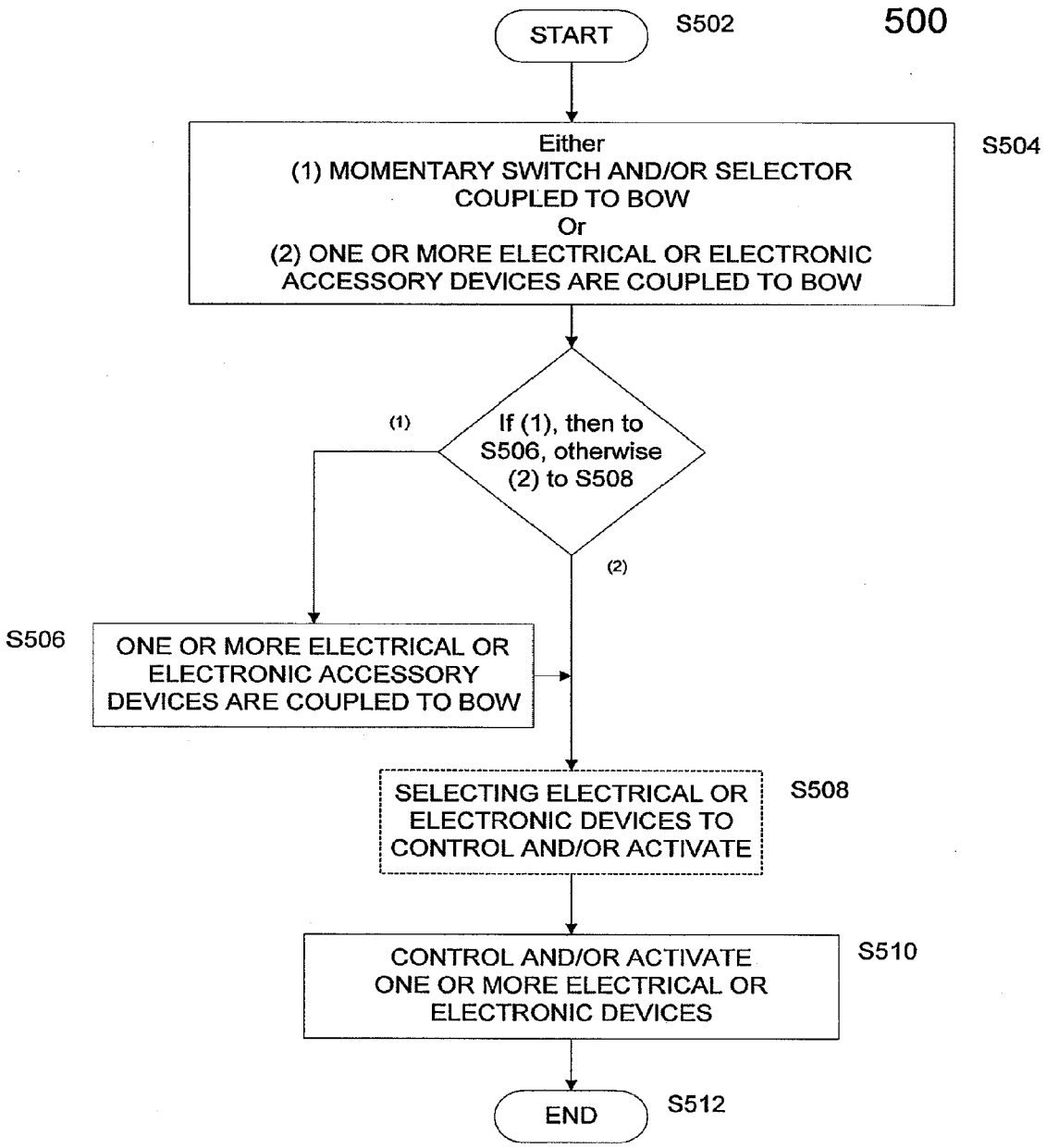
FIG. 5 is a flow chart of a method according to various embodiments of the disclosed subject matter.

FIG. 5 is a flow chart of a method 500 according to various embodiments of the disclosed subject matter.

Method 500 can begin at S502 and proceed to S504, whereby either (1) a momentary switch and/or a selector are coupled to the body of an archery apparatus; or (2) one or more electronic or electrical accessory devices are coupled to a momentary switch and/or a selector of the archery apparatus. The one or more electronic or electrical accessory devices can be electrically coupled to the momentary switch and/or selector. If (1), the method can proceed to S506, whereby one or more electronic or electrical accessory devices can be coupled to the momentary switch and/or a selector. As discussed hereinabove, the one or more electronic or electrical accessory devices can be electrically coupled to the momentary switch and/or selector. In either case, the method can then proceed to S508, whereby an optional step of setting, operating, or otherwise activating or using the selector (if optionally implemented) to select which electrical or electronic devices to control, operate, or activate. After either S506 or optional S508, at S510 the momentary switch can be operated or activated to control or activate one or more electronic or electrical accessory devices coupled thereto or one or more electronic or electrical accessory devices selected using the selector. The method can then proceed to S512 where the method ends.

In at least one embodiment, the method can include wireless operation (i.e., control and/or activation). Optionally, for wireless operation of such embodiments, the method can include performing a device discovery operation to identify electrical or electronic accessory devices coupled to receptacles of the bow or in proximity to the bow, prior to operating an electronic control device of wireless type to control and/or activate the electronic or electrical accessory devices discovered (either presently or previously). In various embodiments, the device discovery operation can be performed automatically upon activation of the momentary switch. Alternatively, the device discovery operation can be performed automatically, continuously, and/or periodically.

Figure 6:
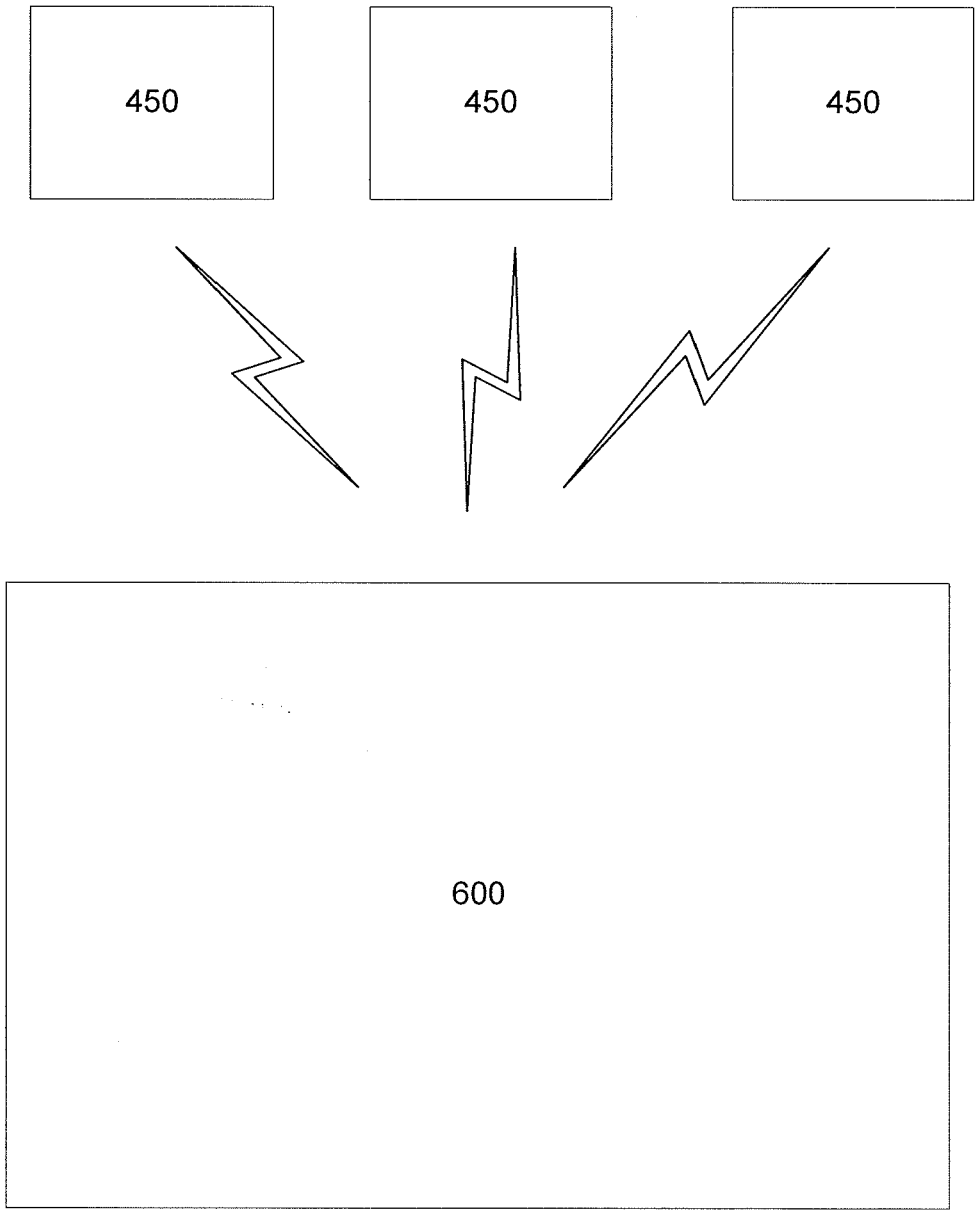
FIG. 6 is block diagram of an electronic control device and electrical or electronic accessory devices for wireless communication therebetween according to various embodiments of the disclosed subject matter.

FIG. 6 is block diagram of an electronic control device 600 and electrical or electronic accessory devices 450 as described herein. As shown in FIG. 6, wireless communication can occur between electronic control device 600 and one or more of the electrical or electronic accessory devices 450 coupled to or otherwise in relative proximity to the electronic control device 600. In various embodiments, the electronic control device 600 can include a wireless transmitter for communicating (i.e., transmitting) wireless signals to receivers associated with the aforementioned electrical or electronic accessory devices 450 coupled to or otherwise in relative proximity to the electronic control device 600. In various embodiments, some or all of the electrical or electronic accessory devices 450 may not be physically connected to a bow or other archery apparatus at all in order to be controlled and/or activated. Electronic control device 600 can be either substantially permanently or temporarily affixed to an archery apparatus, such as bow 100 shown in FIG. 1. The electronic device 600 can wirelessly communicate with respective wireless receivers associated with the one or more electrical or electronic accessory devices 450 to control and/or activate the accessory devices 450. The wireless communication can be of any suitable format, such as by radio frequency ("RF") or by infrared ("IR") signals of any suitable type, frequency, or modulation, such as frequency modulation ("FM"), SSB, etc. Furthermore, in various embodiments, each electronic or electrical accessory device 450 can be operated wirelessly via a unique control frequency. In various embodiments, the electronic control device 600 can control power supplied to the aforementioned electrical or electronic accessory devices 450. Optionally, power supplied to the electrical or electronic accessory devices 450 can be provided by power supplies located on the electrical or electronic accessory devices 450 themselves.

In various embodiments, the electronic control device 600 can include momentary switch 202 and/or selector 208 (not explicitly shown in FIG. 6). In the case of an electronic control device 600 comprised of a momentary switch, such as momentary switch 202 and a selector, such as selector 208, the momentary switch can include a wireless transmitter (e.g., an RF or IR transmitter) and the selector can include a wireless transceiver (e.g., an RF or IR transceiver). In such embodiments, the momentary switch and the selector can communicate wirelessly with each other via the wireless transmitter and transceiver to control and/or activate one or more electrical or electronic accessory devices 450 based on a user input; the momentary switch and/or the selector can communicate wirelessly with wireless receivers (e.g., an RF or IR receiver) of the one or more electrical or electronic accessory devices 450. For example, in various embodiments, the selector can be set or otherwise used to selectively control wireless communication from the momentary switch for one or more electronic or electrical accessory devices 450. Thus, in this example, one or more of the electronic or electrical accessory devices 450 can be selectively activated (e.g., power turned on) based on the configuration of the selector. Optionally, wireless communication can be provided by the momentary switch directly to the one or more electronic devices 450 based on the configuration of the selector. Optionally or alternatively, the one or more electronic accessory devices 450 can receive wireless communication from the selector based on wireless communication from the transmitter of the momentary switch.

Optionally, the electronic control device 600 can perform a device discovery operation to identify electrical or electronic accessory devices 450 coupled to receptacles or in proximity thereto. In various embodiments the device discovery operation is performed automatically. Optionally, the device discovery operation is performed automatically, continuously, and/or periodically.

While the invention(s) has/have been described in conjunction with a number of embodiments, it is evident that many alternatives, modifications and variations would be or are apparent to those of ordinary skill in the applicable arts. Accordingly, Applicant intends to embrace all such alternatives, modifications, equivalents, and variations that are within the spirit and scope of the invention(s) described herein.

What is claimed is:

1. A compound archery bow comprising:

a bow string; and an elongate body operatively coupled to the bow string, the body including an integrated selector, a grip portion having an integrated momentary switch, an integrated stabilizer mounting port, and a plurality of accessory attachment ports, wherein the momentary switch includes a wireless transmitter, wherein the selector includes a wireless transceiver, wherein the momentary switch and the selector are configured to communicate wirelessly with each other via the transmitter and transceiver, wherein the selector is configured to selectively control wireless communication from the momentary switch for one or more electronic accessory devices mechanically coupled to respective accessory attachment ports, and wherein the momentary switch is configured to activate one or more of the electronic accessory devices mechanically coupled to respective accessory attachment ports based on the selective control of the selector.

2. The compound archery bow of claim 1, wherein said one or more electronic accessory devices each include a receiver to receive wireless communication from the compound archery bow.

3. The compound archery bow of claim 2, wherein said one or more electronic accessory devices receive wireless communication from the selector based on communication from the transmitter of the momentary switch.

4. The compound archery bow of claim 1, wherein the selector includes visual indicators to indicate selective control of the one or more electronic accessory devices.

5. The compound archery bow of claim 1, wherein the momentary switch is configured to be activated by a user of the bow.

6. The compound archery bow of claim 1, wherein the electronic accessory devices include at least one of a light, a stabilizing light, a spot light, a video device, a photographic device, an audio enhancement device, a reel device, a game calling device, a range finder device, a sighting device, and a lighted quiver device.

7. The compound archery bow of claim 1, wherein, upon activation, power to the one or more electronic accessory devices mechanically coupled to respective accessory attachment ports based on the selective control of the selector is provided from one or more respective power sources of the one or more electronic accessory devices.

8. The compound archery bow of claim 2, wherein said one or more electronic accessory devices receive wireless communication from the transmitter of the momentary switch based a selection configuration of the selector.

9. The compound archery bow of claim 1, wherein the selector is configured to allow none, only one, only some, or all electronic accessory devices to be operated at one time, with each said electronic accessory device having a unique control frequency or code associated therewith.

10. The compound archery bow of claim 1, wherein the electronic accessory devices include a stabilizing light, the stabilizer mounting port being configured to be mechanically coupled to the stabilizing light, and the stabilizing light being wirelessly controlled by the selector and the momentary switch.

11. An archery apparatus comprising:

a bow string; and a body operatively coupled to the bow string, the body including a grip portion, a wireless control device, and one or more accessory ports, wherein each of the accessory ports provides a mechanical coupling to the body for respective electrical accessory devices, wherein the wireless control device is configured to wirelessly control electrical accessory devices coupled to the body, the wireless controlling including controlling a supply of power, and wherein the wireless control device is configured to be activated by a user of the archery apparatus, the activation of the wireless control device providing power to certain electrical accessory devices coupled to the body.

12. The archery apparatus of claim 11, wherein the supply of power includes one or more power supplies for each of the electrical accessory devices, the one or more power supplies being respectively provided by the electrical accessory devices, and wherein the wireless control is provided by one of RF signals or IR signals.

13. The archery apparatus of claim 11, wherein the electrical accessory devices include at least one of a light, a stabilizing light, a spot light, a video device, a photographic device, an audio enhancement device, a reel device, a game calling device, a range finder device, a sighting device, and a lighted quiver device.

14. A system for controlling activation of one or more accessory devices electrically coupled to an archery apparatus, the system comprising:

means for wirelessly controlling power supplied to said one or more of said accessory devices for activation thereof;

means for coupling to a first external body portion of the archery apparatus said means for wirelessly controlling power;

means for wirelessly selecting said one or more accessory devices for activation thereof; and means for coupling to a second external body portion of the archery apparatus said means for wirelessly selecting said one or more accessory devices for activation, wherein said means for wirelessly controlling power includes wireless connection means for wirelessly communicating with said means for wirelessly selecting said one or more accessory devices for activation, said wireless connection means being exposed from the body of the archery apparatus.

15. The system for controlling activation of one or more accessory devices electrically coupled to an archery apparatus according to claim 14, wherein said means for wirelessly selecting said one or more accessory devices for activation uses a plurality of wireless communication channels, each said one or more accessory device having associated therewith one of said plurality of wireless communication channels.

16. The system for controlling activation of one or more accessory devices electrically coupled to an archery apparatus according to claim 14, wherein said means for wirelessly selecting said one or more accessory devices for activation is configured to selectively allow none, only one, only some, or all electrical accessory devices to be operated substantially simultaneously.

17. A method comprising:

coupling a plurality of devices each having an electrical component to respective receptacles of a compound bow;

operating one or both of a momentary switch and a selector to selectively and wirelessly control the electrical components of the devices; and prior to operating one or both of a momentary switch and a selector to wirelessly control the electrical component of the device, performing a device discovery operation to identify the devices coupled to the receptacles of the compound bow, said device discovery operation being performed by an electronic controller.

18. The method of claim 17, wherein said device discovery operation is performed automatically and continuously by the electronic controller.

* * * * *